US007656421B2

(12) United States Patent
Itabashi

(10) Patent No.: US 7,656,421 B2
(45) Date of Patent: Feb. 2, 2010

(54) IMAGE FORMING APPARATUS

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1 day.

(21) Appl. No.: 12/201,664

(22) Filed: Aug. 29, 2008

(65) Prior Publication Data

US 2009/0058978 A1 Mar. 5, 2009

(30) Foreign Application Priority Data

Aug. 31, 2007 (JP) ..... 2007-225501

(51) Int. Cl.
*G03G 15/00* (2006.01)

(52) U.S. Cl. ..... 347/138; 347/152; 347/245; 347/263; 399/125

(58) Field of Classification Search ..... 399/107, 399/110, 125, 126; 347/135, 245, 263, 152
See application file for complete search history.

(56) References Cited

U.S. PATENT DOCUMENTS 5,808,649 A 9/1998 Shimanari
6,038,417 A * 3/2000 Nagamine et al. ..... 399/125
7,388,593 B2 * 6/2008 Fukuda ..... 347/138
2008/0219696 A1 * 9/2008 Itabashi ..... 399/114
2008/0219697 A1 * 9/2008 Itabashi ..... 399/114
2008/0259364 A1 * 10/2008 Morita et al. ..... 358/1.9
2008/0304860 A1 * 12/2008 Hisada ..... 399/110

FOREIGN PATENT DOCUMENTS

JP 09-160333 6/1997
JP 2006106134 * 4/2006
JP 2007-065125 3/2007

* cited by examiner

*Primary Examiner*—Huan H Tran
(74) *Attorney, Agent, or Firm*—Banner & Witcoff, Ltd

(57) ABSTRACT

An image forming apparatus includes: a main body including an opening; a plurality of process units which are arranged in the main body in an arrangement direction with a gap therebetween; a plurality of exposure units which are arranged in the arrangement direction alternately with the process units; a cover which is rotatable about a rotation shaft to open and close the opening; and a plurality of support members which connect the exposure units to the cover and which allow the exposure units to be retreated from the process units with the opening and closing of the cover. The process units are disposed at positions where the process units contact with the exposure units moved with the opening and closing of the cover and at least contact portions thereof contacting with the exposure units are movable by pressing forces of the exposure units.

11 Claims, 12 Drawing Sheets

IMAGE FORMING APPARATUS

CROSS-REFERENCE TO RELATED APPLICATION

This application claims priority from Japanese Patent Application No. 2007-225501, filed on Aug. 31, 2007, the entire subject matter of which is incorporated herein by reference.

TECHNICAL FIELD

Aspects of the present invention relate to an image forming apparatus in which an LED head is supported by a rotatable cover.

BACKGROUND

Image forming apparatuses form an image on a printing sheet by emitting light to a charged photosensitive drum, change a potential of portions exposed to the light to form an electrostatic latent image on the photosensitive drum, and transfer a developer image formed with the supply of developer to the electrostatic latent image onto the printing sheet.

In some of such image forming apparatuses, plural LED heads which emits light to plural photosensitive drums and plural process units which includes the photosensitive drums and toner containers are alternately arranged in a direction (see JP-A-H9-160333). In the image forming apparatuses, the LED heads are supported by a rotatable top cover and can get close to and apart from the photosensitive drums.

However, with the above-described configuration, since each LED head is moved along an arc-shaped locus, gaps between the process units should be large so that the LED heads do not interfere with the process units when rotating the top cover, thereby increasing the size of the apparatus.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus which can reduce a size of the apparatus by reducing a gap between process units or gap between a process unit and a wall of the apparatus.

According to an exemplary embodiment of the present invention, there is provided an image forming apparatus including: a main body including an opening at one side thereof; a plurality of process units which are arranged in the main body in an arrangement direction with a gap therebetween, and each of which includes a photosensitive member on which an electrostatic latent image is to be formed; a plurality of exposure units which are arranged in the arrangement direction alternately with the process units and which expose the photosensitive members, respectively; a cover which is rotatable about a rotation shaft at one end in the arrangement direction and which opens and closes the opening of the main body; and a plurality of support members which connect the exposure units to the cover and which allow the exposure units to be retreated from the process units with the opening and closing of the cover. The rotation shaft of the cover is disposed closer to the opening of the main body than ends of the exposure units located at exposure positions for exposing the photosensitive members when the cover closes the opening of the main body. The process units are disposed at positions where the process units contact with the exposure units moved with the opening and closing of the cover and at least contact portions thereof contacting with the exposure units are movable by pressing forces of the exposure units.

According to another exemplary embodiment of the present invention, there is provided an image forming apparatus including: a main body including an opening; a cover which is rotatable about a rotation shaft provided at one side of the main body to open and close the opening; a process unit provided in the main body and including a photosensitive member; an exposure unit which is connected to the cover and is moved with the opening and closing of the cover along a movement locus, wherein the exposure unit faces the photosensitive member when the cover closes the opening; and an elastic member which supports the process unit and is elastically deformable between an overlapping state in which the process unit overlaps with the movement locus of the exposure unit and a retreated state in which the process unit is retreated from the movement locus of the exposure unit.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

First Exemplary Embodiment

Figure 1:
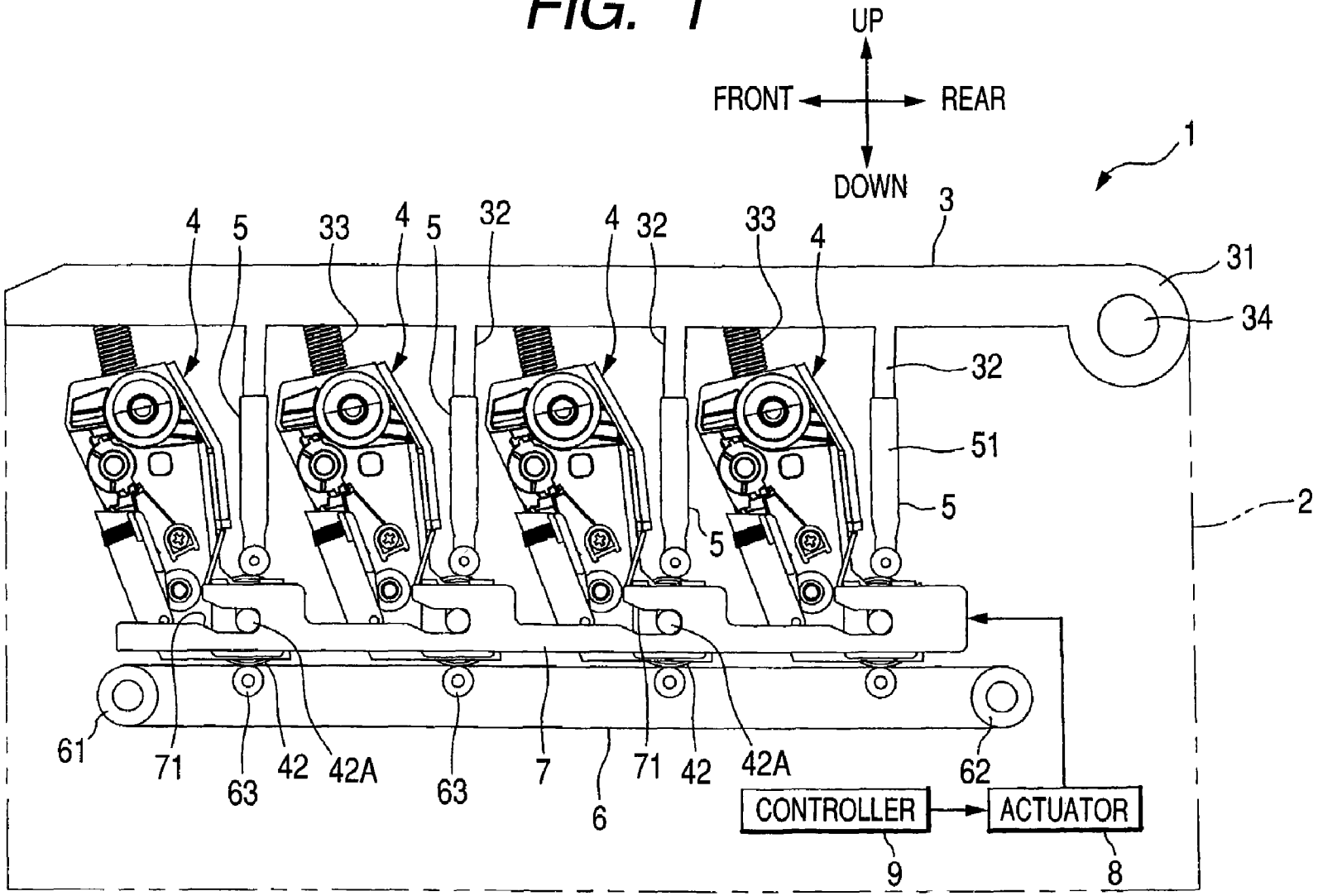
FIG. 1 is a side view illustrating a color printer according to a first exemplary embodiment of the present invention.
Figure 2A:
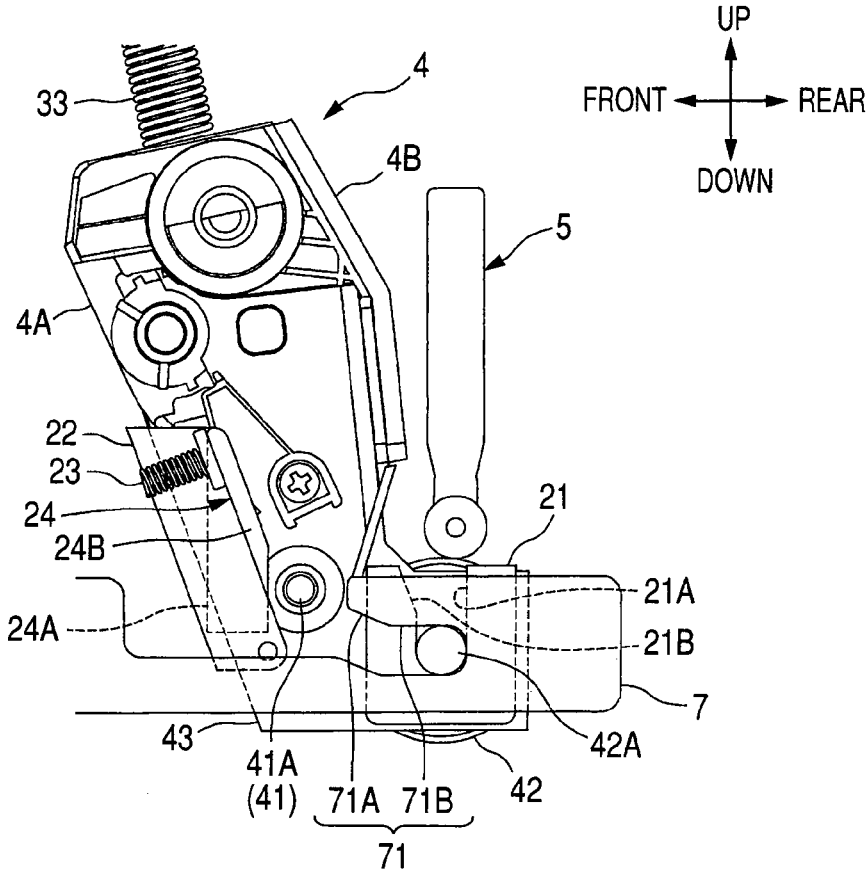
FIG. 2A is a side view illustrating a process unit and FIG. 2B is a perspective view illustrating a unit supporting member.
Figure 2B:
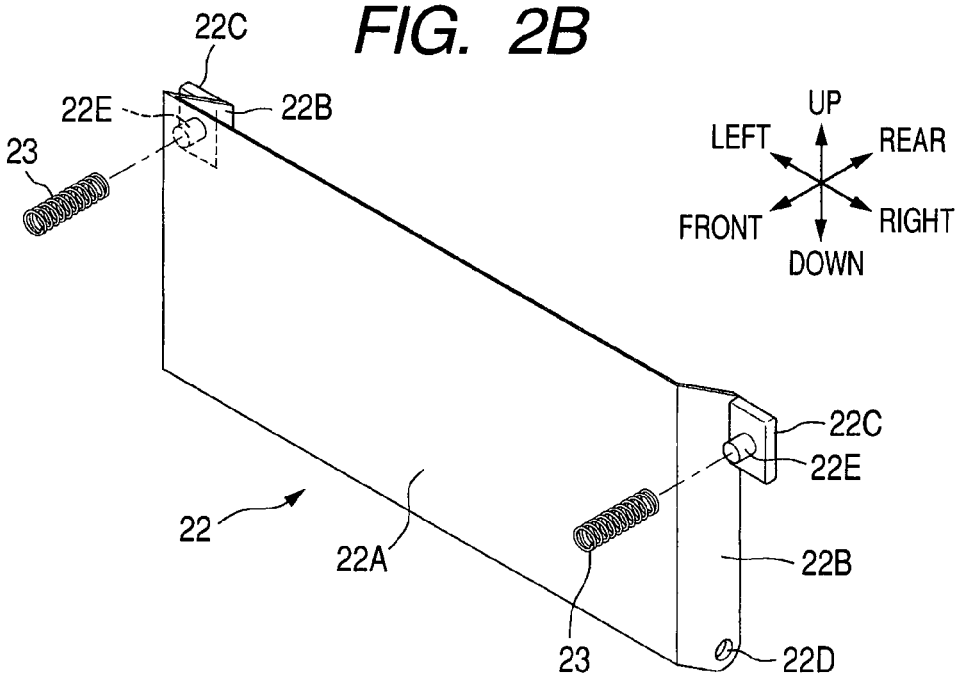
Figure 3:
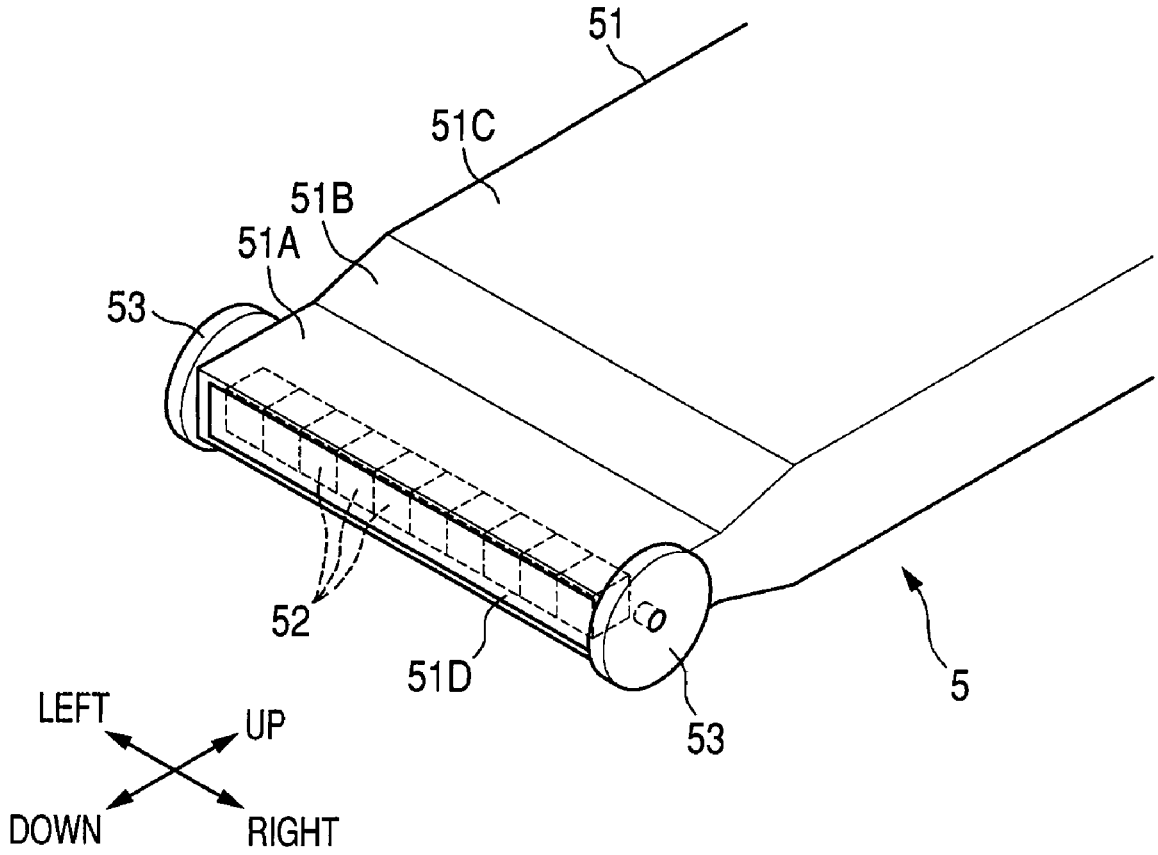
FIG. 3 is a perspective view illustrating an LED head.

Hereinafter, a first exemplary embodiment of the present invention will be described in detail with reference to the accompanying drawings. In the drawings, FIG. 1 is a side view illustrating a color printer according to the first exemplary embodiment of the present invention. FIG. 2A is a side view illustrating a process unit and FIG. 2B is a perspective view illustrating a unit supporting member. FIG. 3 is a perspective view illustrating an LED head. In the following description, directions are taken based on use of the color printer 1. That is, the left side in FIG. 1 is referred to as "front", the right side is referred to as "rear", the inside in the direction perpendicular to the drawing sheet is referred to as "left", and the front side in the direction perpendicular to the drawing sheet is referred to as "right". The vertical direction is referred to as "vertical direction" since the drawn direction is equal to that of the use.

<Color Printer>

As shown in FIG. 1, a color printer 1 includes a main body 2 having a box shape of which the top side is opened and a cover 3 which opens and closes the opening of the main body 2.

<Main Body>

Process units 4, LED heads 5, a belt 6, a separation member 7, an actuator 8, and a controller 9 are disposed in the main body 2. In addition to the above-mentioned components, a sheet feeding tray, a conveying mechanism, and a fixing device, which are know, are properly disposed in the main body 2.

<Cover>

The cover 3 is rotatable about a rear end 31. Four support arms 32 supporting four LED heads 5, respectively, are provided on the bottom surface of the cover 3 and four coil springs 33 obliquely urging four process units 4 to the downside and the rear side are provided. Here, the support arms 32 may be formed monolithically with or separately from the cover 3. Since the LED heads 5 are supported by the support arms 32 of the cover 3, respectively, the ends of the LED heads 5 are located at exposure positions where photosensitive drums 42 are exposed when the cover 3 is closed. And, the LED heads 5 are retreated from the exposure positions when the cover 3 is opened. The rotation shaft 34 of the cover 3 is disposed closer to the opening of the main body 2 than the ends of the LED heads 5 located at the exposure positions. Accordingly, the LED heads 5 are moved along with the opening and closing of the cover 3 in an arc-shaped locus protruding to the front side and contacts with or overlaps with the process units 4.

<Process Unit>

Four process units 4 are arranged in the front-rear direction with gaps therebetween and contain colors different from one another, respectively. As shown in FIG. 2A, each process unit 4 includes a developing roller 41, a photosensitive drum 42. In addition, each process unit 4 includes a toner container, a supply roller, and a charger, which are known.

The developing roller 41 supplies toner supplied from the toner container through the supply roller to the photosensitive drum 42 and is disposed to be in contact with the photosensitive drum 42. The rotation shaft 41A of the developing roller 41 is rotatably supported by an outer frame 43 so as to protrude outward from the outer frame 43 constituting the outer surface of the process unit 4.

The photosensitive drum 42 is charged by the charger and is exposed by the LED head 5, whereby an electrostatic latent image formed thereon. The rotation shaft 42A is rotatably supported by the outer frame 43 so as to protrude outward from the outer frame 43. The rotation shaft 42A of the photosensitive drum 42 is rotatably supported by a U-shaped bracket 21 fixed to the main body 2, whereby the process unit 4 is pivotable about the rotation shaft 42A of the photosensitive drum 42.

Here, the bracket 21 is disposed so that the U-shaped groove 21A faces the upside. The front side surface 21B of the groove 21A of the bracket 21 is gradually inclined to the front side as it goes to the upside. With this configuration, the process unit 4 can be easily attached to the main body 2 since the rotation shaft 42A of the photosensitive drum 42 is guided to the bottom surface of the groove 21A of the bracket 21.

The front surface 4A of the process unit 4 is supported by a unit supporting member 22 pivotably supported by the main body 2. As shown in FIG. 2B, the unit supporting member 22 includes a support portion 22A having a rectangular plate shape, side wall portions 22B extending rearward from both ends of the support portion 22A, and contact surface portions 22C extending outward in the right-left direction from the top portions of the side wall portions 22B. A rotation center hole 22D rotatably engaging with an axis portion (not shown) such as a bolt fixed to the main body 2 is formed in the lower portion of each side wall portion 22B, whereby the unit supporting member 22 is pivotably supported by the main body 2. The front surfaces of the contact surface portions 22C are urged rearward by a coil spring 23 and thus contacts with a stopper 24 shown in FIG. 2A. Here, the stopper 24 includes a plate-like portion 24A fixed to the main body 2 and an extension 24B extending outward in the right-left direction from the rear upper portion of the plate-like portion 24A. A position regulating protrusion 22E is formed on the front surface of each contact surface portion 22C so as to protrude to the front side. The position regulating protrusions 22E suppress the springs 23 provided between the main body 2 and the contact surface portion 22C from laterally or vertically deviating.

The process unit 4 urged rearward by the urging force of the spring 23 comes in contact with the main body 2 at a proper position, whereby the rearward movement thereof is regulated and the posture thereof in the front-rear direction is stabilized. Since the process unit 4 is urged obliquely to the front side and the rear side by the urging force of the spring 33, the photosensitive drum 42 is urged toward the belt 6 (specifically, a transfer roller 63, described in detail later).

The rear portion of the process unit 4 is disposed at a position where the process unit 4 contacts with the LED head 5 while the LED head 5 is moved in an arc-shaped locus with the rotation of the cover 3. Accordingly, the process unit 4 is pressed forward by the LED head 5 moved in the arc-shaped locus and pivots about the rotation shaft 42A of the photosensitive drum 42. The upper portion of the rear surface 4B of the process unit 4 is oblique with respect to the vertical direction. Specifically, the upper portion of the surface 4B is oblique with respect to the direction (entering direction) in which the LED head 5 is moved to the photosensitive drum 42 with the rotation of the cover 3.

<LED Head>

As shown in FIG. 1, the LED heads 5 are arranged in the front-rear direction alternately with the process units 4. As shown in FIG. 3, each LED head 5 includes a head body 51, LEDs (Light Emitting Diode) 52, and rollers 53.

The head body 51 includes a small-width portion 51A, a tapered portion 51B, and a great-width portion 51C sequentially from the downside. The end of the small-width portion 51A is provided with a lens surface 51D which transmits light emitted from the LED 52. As shown in FIG. 1, the upper portion of the head body 51 is connected to the support arm 32 so as to be vertically slidable.

Plural LEDs 52 are arranged in a line in the axis direction of the photosensitive drum 42. In this exemplary embodiment, plural LEDs 52 are arranged in a single line, but the present invention is not limited to such single line and the LEDs may be arranged in plural lines.

The rollers 53 are rotatably provided in the lower portions of both side surfaces of the small-width portion 51A of the head body 51, respectively. The rollers 53 press the rear surface 4B of the process unit 4 and rotate when the LED head 5 is moved in the arc-shaped locus with the rotation of the cover 3.

<Belt>

As shown in FIG. 1, the belt 6 has an endless shape, is wound around a driving roller 61 and a driven roller 62, and is rotated by the driving roller 61 to convey a printing sheet. Here, a sheet of paper or an OHP sheet may be used as the printing sheet. Four transfer rollers 63 opposed to the photosensitive drums 42 with the belt 6 interposed therebetween are disposed inside the belt 6. By applying a voltage to the transfer rollers 63, the toner (specifically, toner held in portions on which electrostatic latent images: toner images) held on the photosensitive drums 42 is transferred onto the printing sheet between the photosensitive drums 42 and the transfer rollers 63.

<Separation Member>

The separation members 7 allow the photosensitive drums 42 to move up against the urging force of the springs 33, have a plate shape extending in the front-rear direction, and are provided to be movable in the front-rear direction in both sides with each photosensitive drums 42 interposed therebetween. Four engaging grooves 71 for engaging with the rotation shafts 42A of the photosensitive drums 42 are formed in each separation member 7. As shown in FIG. 2A, each engaging groove 71 includes a tilt groove 71A tilted downward from the opening end to the rear side and a horizontal groove 71B extending straightly from the rear end of the tilt groove 71A to the rear side. Accordingly, when the separation members 7 are moved from the position shown in FIG. 2A to the rear side, the rotation shaft 42A of the photosensitive drum 42 is pressed up by the lower wall of the tilt groove 71A and thus the photosensitive drum 42 is separated from the belt 6 along the groove 21A of the bracket 21. In the following description, a position at which the photosensitive drum 42 is closest to the belt 6 is referred to as a "close position" and a position at which the photosensitive drum 42 is more apart from the belt 6 than the close position is referred to as a "separated position".

<Actuator>

As shown in FIG. 1, the actuator 8 moves the separation member 7 in the front-rear direction by using gears (not shown). The actuator 8 is properly controlled by the controller 9.

<Controller>

The controller 9 controls the actuator 8 to locate the photosensitive drum 42 at the separated position through the separation member 7 during opening and closing the cover 3. A variety of control methods may be employed, but in this exemplary embodiment, for example, a lock state detecting sensor detecting a locked/unlocked state of a locking member fixing the cover 3 to the main body 2 in the closed state is provided and the following method is employed. That is, when determining that the locking member is in a locked state on the basis of the a signal from the lock state detecting sensor, the controller 9 moves or holds the separation member 7 to the position shown in FIG. 1 through the actuator 8. When determining that the locking member is unlocked on the basis of the signal from the lock state detecting sensor, the controller 9 moves or holds the separation member 7 to a predetermined position (see FIG. 4B) more rear than the position shown in FIG. 1 through the actuator 8.

Figure 4A:
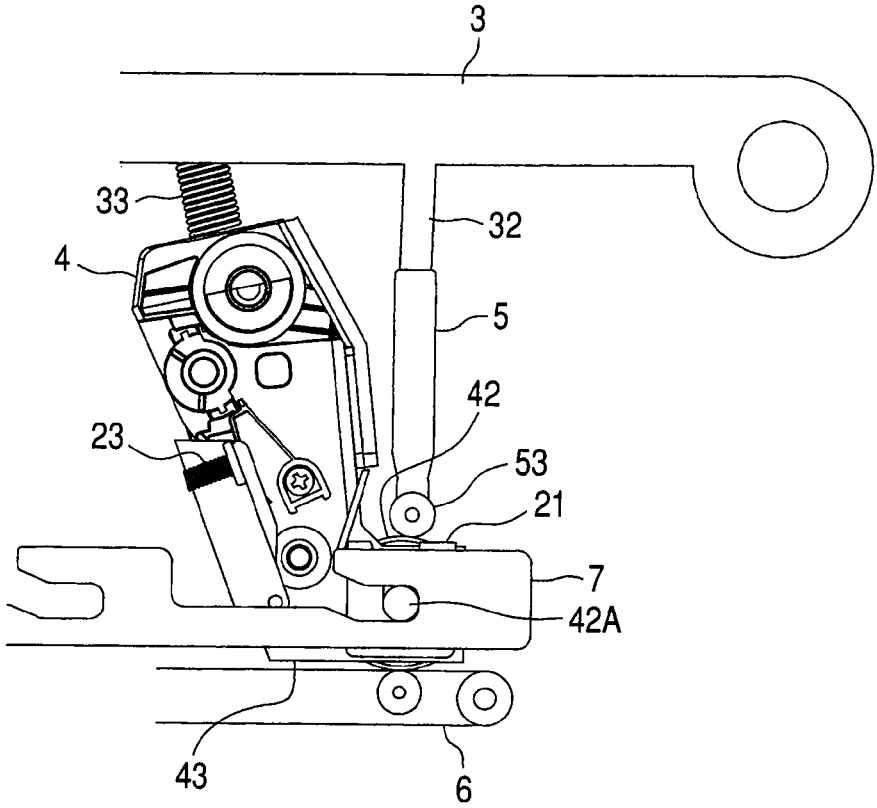
FIG. 4A is a side view illustrating a state of the process unit where a cover is closed and FIG. 4B is a side view illustrating a state of the process unit where a photosensitive drum is pushed up by a separation member.
Figure 4B:
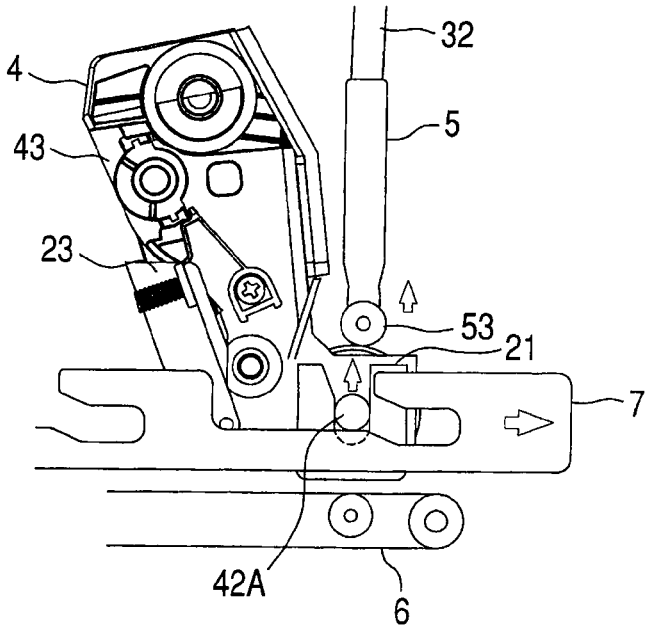
Figure 5A:
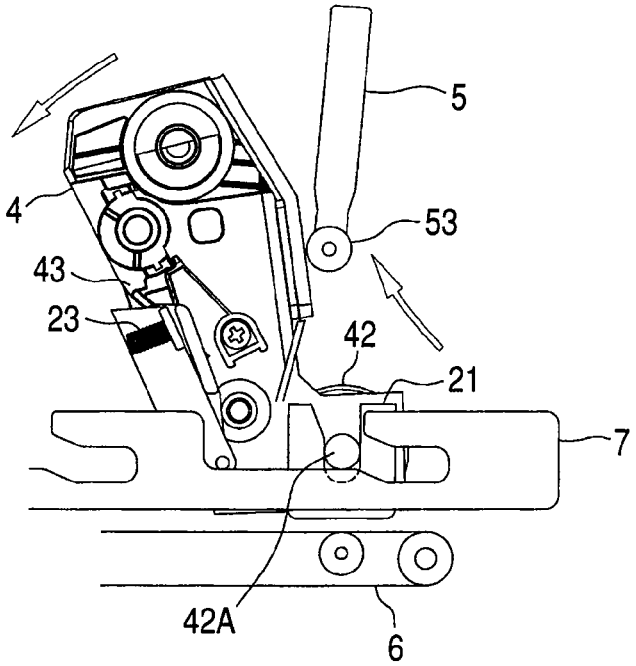
FIG. 5A is a side view illustrating a state of the process unit where it is started opening the cover and FIG. 5B is a side view illustrating a state of the process unit where the cover is opened by a predetermined amount or more.

Operations of the process units 4 at the time of opening and closing the cover 3 of the color printer 1 according to this exemplary embodiment will be described now. In the drawings, FIG. 4A is a side view illustrating a state of the process unit where the cover is closed and FIG. 4B is a side view illustrating a state of the process unit where the photosensitive drum is pushed up by the separation member 7. FIG. 5A is a side view illustrating a state of the process unit where it is started opening the cover and FIG. 5B is a side view illustrating a state of the process unit where the cover is opened by a predetermined amount or more.

When the locking member is unlocked to open the cover 3 from the state shown in FIG. 4A, the controller 9 controls the actuator 8 to move the separation member 7 to the rear side as shown in FIG. 4B. Accordingly, the rotation shaft 42A of the photosensitive drum 42 is pushed up by the separation member 7 and the photosensitive drum 42 is separated from the belt 6. At this time, the outer frame 43 of the process unit 4, which supports the photosensitive drum 42 is moved up at the same time. When the photosensitive drum 42 is moved up, the photosensitive drum 42 comes in contact with the LED head 5 located above. However, the LED head 5 is supported to be slidable with respect to the support arm 32, and therefore, the LED head 5 is moved along with the photosensitive drum 42. Accordingly, the damage due to the contact between the photosensitive drum 42 and the LED head 5 is suppressed.

Thereafter, when opening of the cover 3 is started, as shown in FIG. 5A, the LED head 5 is moved in an arc-shaped locus and the roller 53 presses the process unit 4 to the front side. Accordingly, the process unit 4 pivots about the rotation shaft 42A of the photosensitive drum 42. That is, the process unit 4 located in the movement locus of the LED head 5 is retreated from the movement locus by the LED head 5 moved in the arc-shaped locus. When the cover 3 is further opened, the LED head 5 gets gradually apart from the process unit 4 and thus the process unit 4 is restored to the original position with the urging force of the spring 23 as shown in FIG. 5B.

Figure 5B:
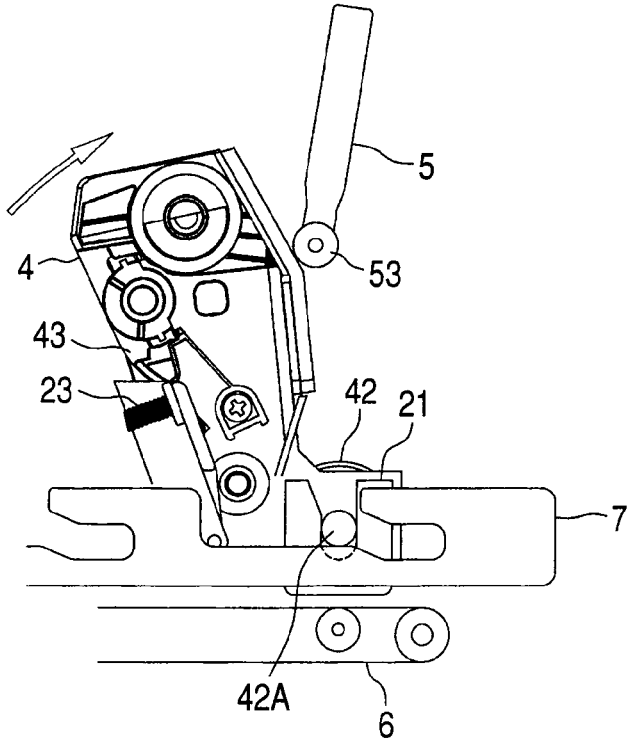

When the cover 3 is closed, as shown in the order of FIGS. 5B, 5A, and 4A, the process unit 4 is retreated from the movement locus with the pressing of the LED head 5 and then is restored to the original position with the urging force of the spring 23. Then, when the cover 3 is completely closed and is locked by the locking member, the controller 9 controls the actuator 8 to move the separation member 7 to the original position on the front side, as shown in the order of FIGS. 4B and 4A. Accordingly, the process unit 4 urged with the spring 33 is moved downward and the photosensitive drum 42 comes in contact with the belt 6 again.

According to the above-described configuration of this exemplary embodiment, the following advantages can be obtained.

At the time of opening and closing the cover 3, since the process unit 4 is pressed by the moved LED head 5 and is retreated from the movement locus of the LED head 5, it is possible to reduce the gap between the process units 4, thereby reducing the size of the apparatus.

Since the spring 23 urging the process unit 4 to the original position is provided, the process unit 4 once deviated from the original position by the LED head 5 can be automatically restored to the original position by the spring 23, only by closing the cover 3. Accordingly, it is possible to easily position the process unit 4 after closing the cover 3.

At the time of opening and closing the cover 3, since the photosensitive drum 42 is separated from the belt 6 by the separation member 7, the sliding contact between the photosensitive drum 42 and the belt 6 is prevented at the time of pivoting the process unit 4, thereby suppressing the abrasion of the photosensitive drum 42 and the belt 6.

Since the upper portion of the rear surface 4B of the process unit 4 is oblique with respect to the entering direction of the LED head 5, the forward or rearward force is easily applied to the process unit 4 by means of contact with the LED head 5, thereby allowing the process unit 4 to fall down efficiently.

Since the rollers 53 are provided in the LED head 5, it is possible to suppress the abrasion of the LED head 5 and the process unit 4 at the time of the sliding contact between the LED head 5 and the process unit 4.

Second Exemplary Embodiment

A second exemplary embodiment of the present invention will be described in detail now with reference to the accompanying drawings. In this exemplary embodiment, the structures of the process unit and the separation member according to the first exemplary embodiment are modified. Accordingly, the same elements as the first exemplary embodiment are denoted by the same reference numerals and signs and description thereof is omitted. In the drawings, FIG. 6 is a side view illustrating a peripheral structure of a process unit according to the second exemplary embodiment of the present invention, FIG. 7A is a side view illustrating a state where the developing roller comes in contact with the photosensitive drum, and FIG. 7B is a side view illustrating a state where the developing roller is separated from the photosensitive drum.

Figure 6:
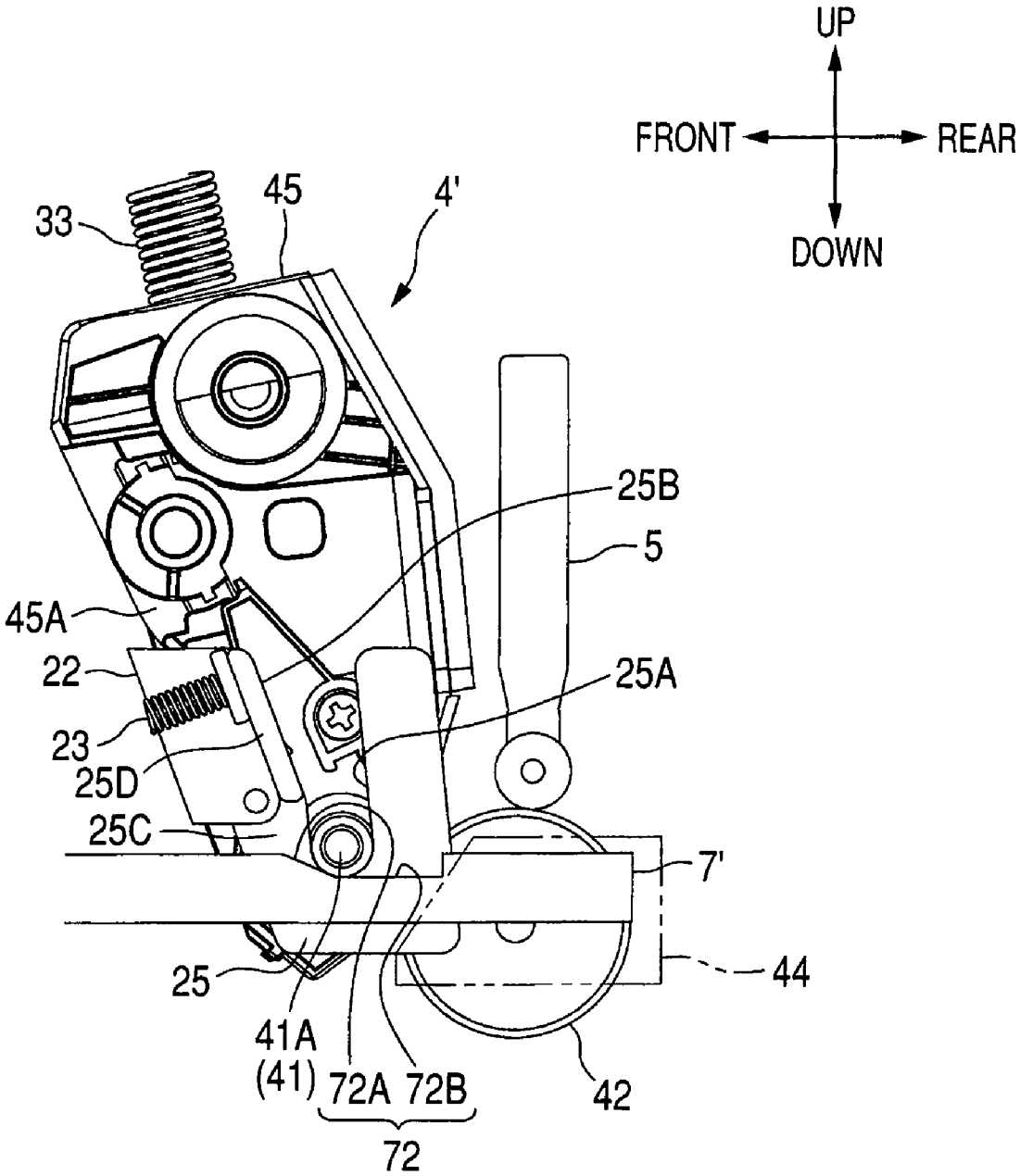
FIG. 6 is a side view illustrating a peripheral structure of a process unit according to a second exemplary embodiment of the present invention.
Figure 7A:
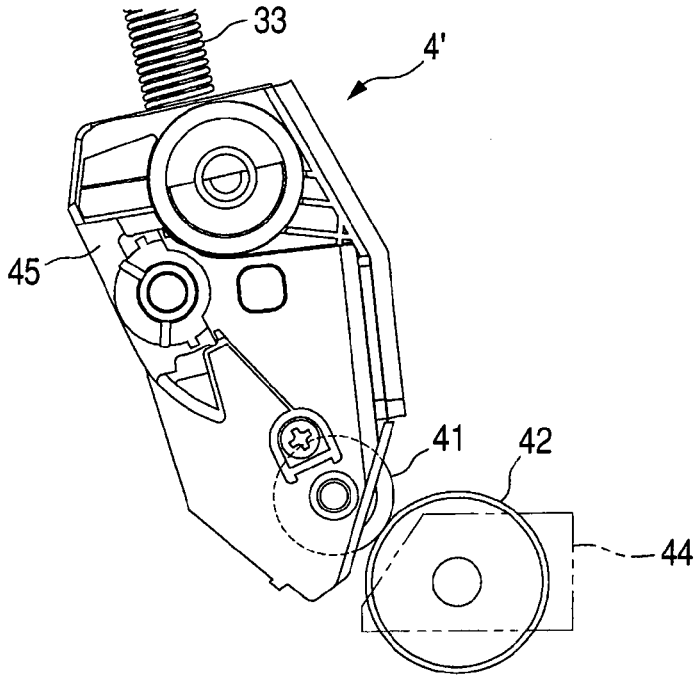
FIG. 7A is a side view illustrating a state where a developing roller and a photosensitive drum come in contact with each other and FIG. 7B is a side view illustrating a state where the developing roller is separated from the photosensitive drum.
Figure 7B:
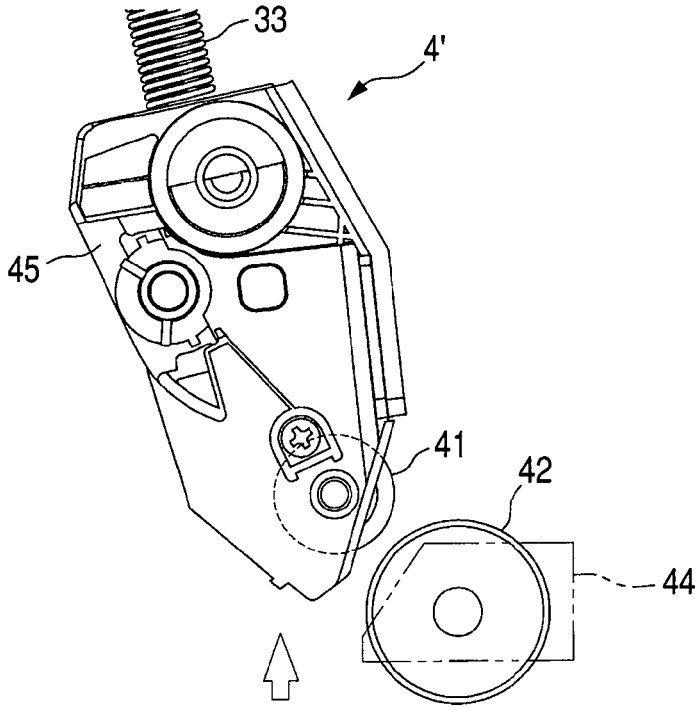

As shown in FIG. 6, the process unit 4' according to the second exemplary embodiment includes a drum cartridge 44 having the photosensitive drum 42 and a developing cartridge 45 having a developing roller 41. Here, the drum cartridge 44 is shown in the drawings by a virtual line so as to easily show that the drum cartridge is separated from the developing cartridge 45. A separation member 7' according to the second exemplary embodiment has a shape different from the separation member 7 according to the first exemplary embodiment.

<Drum Cartridge>

The drum cartridge 44 is positioned and attached to the main body 2, independently from the developing cartridge 45. The drum cartridge 44 includes the charger and the like.

<Developing Cartridge>

The developing cartridge 45 has an outer frame 45A constituting the outer surface thereof. The rotation shaft 41A of the developing roller 41 is rotatably supported by the outer frame 45A so as to protrude outward from the outer frame 45A. The developing cartridge 45 is provided with the toner container and the supply roller.

The rotation shaft 41A of the developing roller 41 protruding from the outer frame 45A is rotatably supported by the U-shaped bracket 25 fixed to the main body 2 and thus the developing cartridge 45 is pivotable about the rotation shaft 41A of the developing roller 41. Here, the bracket 25 has the U-shaped groove 25A facing the upside. The front side surface 25B of the groove 25A of the bracket 25 is gradually inclined to the front side as it goes to the upside. Accordingly, since the rotation shaft 41A of the developing roller 41 is guided to the bottom of the groove 25A of the bracket 25, the developing cartridge 45 can be easily attached to the main body 2. The stopper 24 (see FIG. 2A) same as the first exemplary embodiment is formed monolithically with the bracket 25. That is, an extension 25D extending outward in right-left direction along the side surface 25B is formed in a front arm portion 25C of the U-shaped bracket 25.

<Separation Member>

The separation members 7' allow the rotation shaft 41A of the developing roller 41 provided in each of four process units 4' (of which only one is shown) to move up against the urging force of the spring 33, have a plate shape extending in the front-rear direction, and are provided to be movable in the front-rear direction on both sides with the developing rollers 41 interposed therebetween. Four notches 72 (of which only one is shown) engaging with the rotation shafts 41A of the developing rollers 41 are formed in each separation member 7'. The notches 72 have a concave shape opened to the upside and includes a tilt surface 72A tilted down as it goes from the front end to the rear side and a horizontal surface 72B extending from the rear end of the tilt surface 72A to the rear side. Accordingly, when the separation members 7' are moved from the position shown in FIG. 6 to the rear side, the rotation shat 41A of the developing roller 41 is pressed up by the tilt surface 72A and the developing roller 41 is separated from the photosensitive drum 42 as shown in FIGS. 7A and 7B. Specifically, the developing roller 41 is separated from the photosensitive drum 42 along the groove 25A of the bracket 25 shown in FIG. 6. The separation members 7' are properly move by the same actuator 8 and the same controller 9 as the first exemplary embodiment.

Figure 8A:
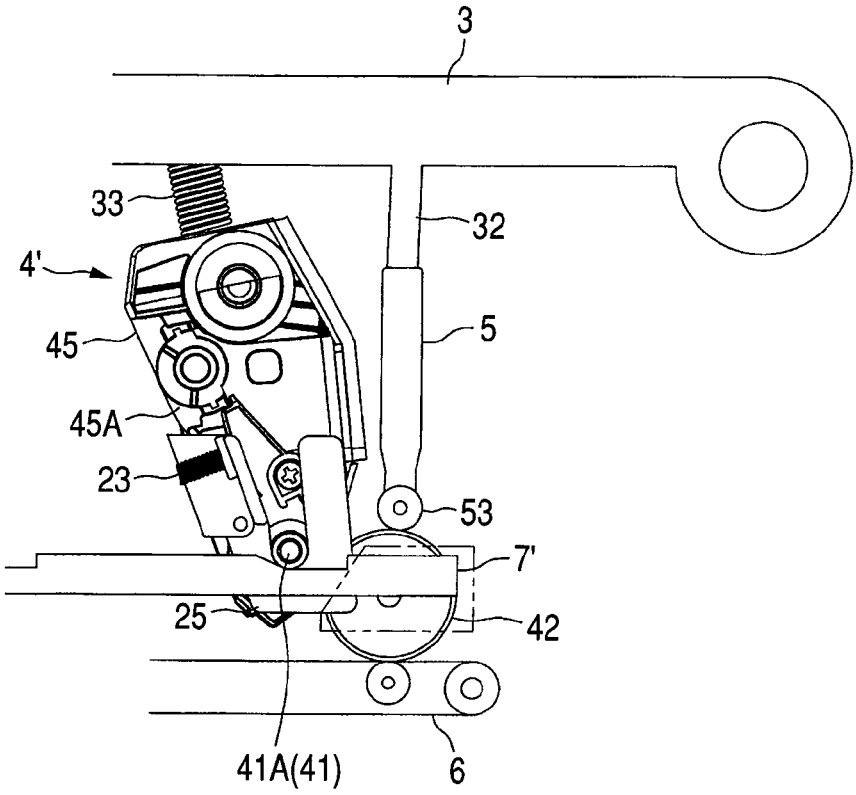
FIG. 8A is a side view illustrating a state of the process unit where the cover is closed and FIG. 8B is a state of the process unit where the developing roller is pushed up by a separation member.
Figure 8B:
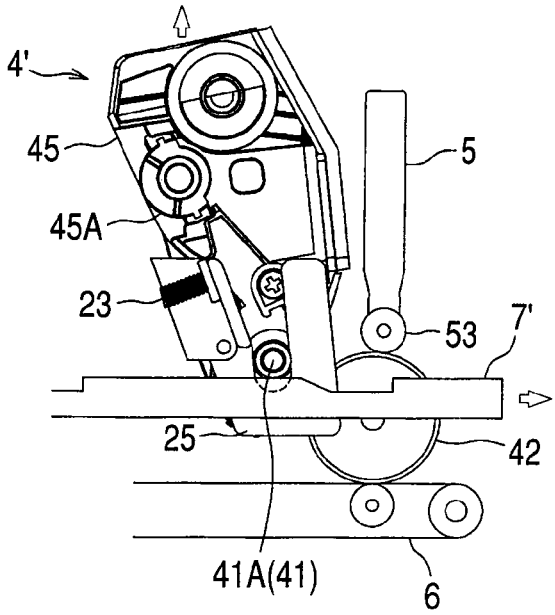
Figure 9A:
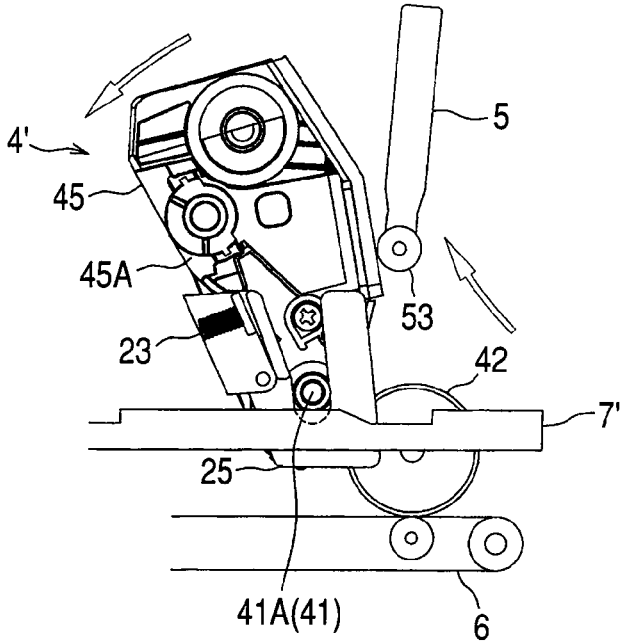
FIG. 9A is a side view illustrating a state of the process unit where it is started opening the cover and FIG. 9B is a side view illustrating a state of the process unit where the cover is opened by a predetermined amount or more.

Operations of the process units 4' at the time of opening and closing the cover 3 of the color printer 1 according to the second exemplary embodiment will be described now. In the drawings, FIG. 8A is a side view illustrating a state of the process unit where the cover is closed and FIG. 8B is a side view illustrating a state of the process unit where the developing roller is pushed up by the separation member. FIG. 9A is a side view illustrating a state of the process unit where it is started opening the cover and FIG. 9B is a side view illustrating a state of the process unit where the cover is opened by a predetermined amount or more.

As shown in FIGS. 8A and 8B, when the separation members 7' are moved to the rear side by the same control as the first exemplary embodiment, the rotation shaft 41A of the developing roller 41 is pushed up by the separation members 7' and the developing roller 41 is separated from the photosensitive drum 42. At this time, the cartridge frame 45A (developing cartridge 45) supporting the developing roller 41 is also moved up.

Thereafter, when it is started opening the cover 3, as shown in FIG. 9A, the LED head 5 is moved in an arc-shaped locus and the roller 53 presses the developing cartridge 45 to the front side. Accordingly, the developing cartridge 45 pivots about the rotation shaft 41A of the developing roller 41. That is, the developing cartridge 45 located in the movement locus of the LED head 5 is retreated from the movement locus by the LED head 5 moved in the arc-shaped locus. When the cover 3 is further opened, the LED head 5 gets gradually apart from the developing cartridge 45 and thus the developing cartridge 45 is restored to the original position with the urging force of the spring 23 as shown in FIG. 9B.

Figure 9B:
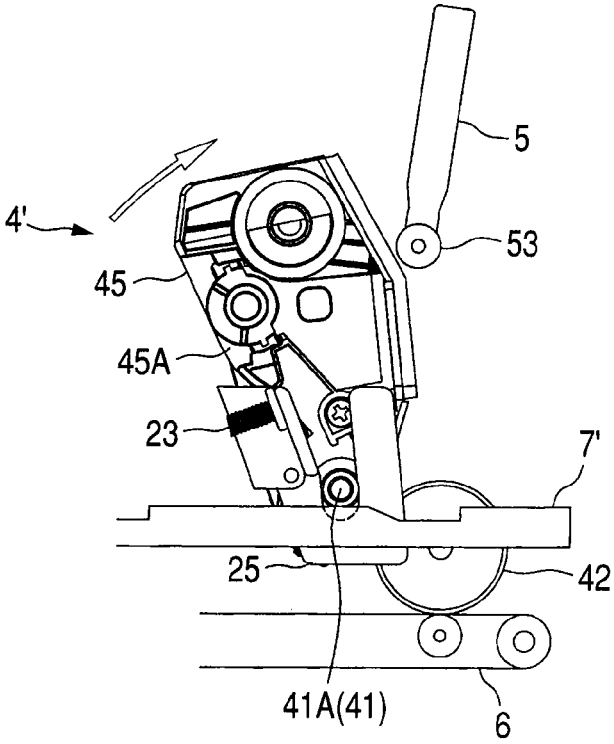

When the cover 3 is closed, as shown in the order of FIGS. 9B, 9A, and 8B, the developing cartridge 45 is retreated from the movement locus with the pressing of the LED head 5 and then is restored to the original position with the urging force of the spring 23. Then, when the cover 3 is completely closed, the separation members 7' are moved to the original position on the front side by the same control as the first exemplary embodiment, as shown in the order of FIGS. 8B and 8A. Accordingly, the developing cartridge 45 urged with the spring 33 is moved downward and the developing roller 41 comes in contact with the photosensitive drum 42 again.

According to the above-described configuration of the second exemplary embodiment, the following advantages can be obtained.

At the time of opening and closing the cover 3, since the developing cartridge 45 as a part of the process unit 4' is pressed by the moved LED head 5 and is retreated from the movement locus of the LED head 5, it is possible to reduce the gap between the process units 4', thereby reducing the size of the apparatus.

At the time of opening and closing the cover 3, since the developing roller 41 is separated from the photosensitive drum 42 by the separation members 7', the sliding contact between the developing roller 41 and the photosensitive drum 42 is prevented at the time of pivoting the developing cartridge 45, thereby suppressing the abrasion of the developing roller 41 and the photosensitive drum 42.

Third Exemplary Embodiment

A third exemplary embodiment of the present invention will be described in detail now with reference to the accompanying drawings. In this exemplary embodiment, the structures of the process unit according to the second exemplary embodiment are modified. Accordingly, the same elements as the second exemplary embodiment are denoted by the same reference numerals and signs and description thereof is omitted. In the drawings, FIG. 10 is a side view illustrating a peripheral structure of a process unit according to the third exemplary embodiment of the present invention.

Figure 10:
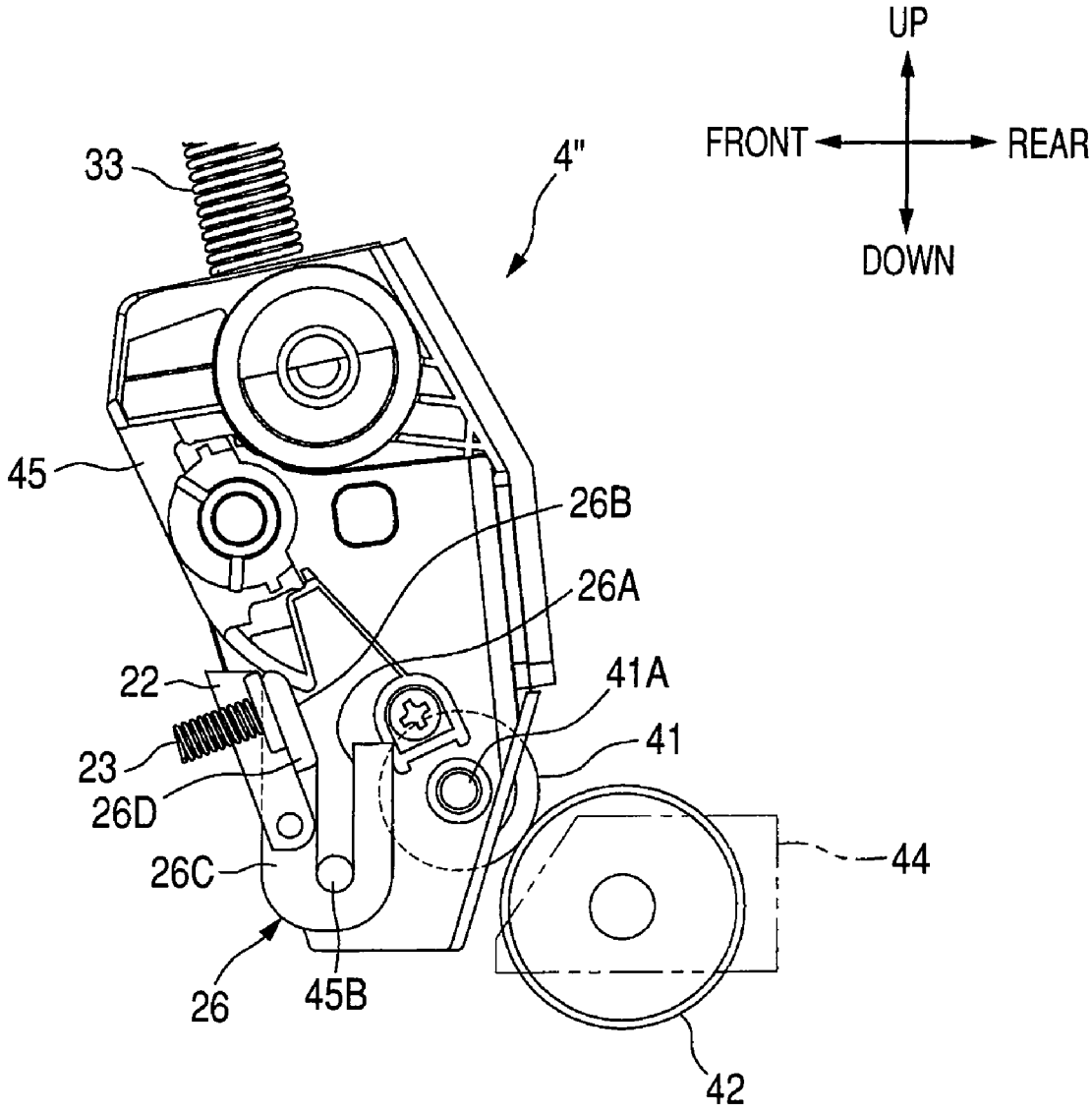
FIG. 10 is a side view illustrating a peripheral structure of a process unit according to a third exemplary embodiment of the present invention.

As shown in FIG. 10, the process unit 4" according to the third exemplary embodiment includes the same drum cartridge 44 and the same developing cartridge 45 as the second exemplary embodiment. Axis portions 45B protruding outward in the lateral direction are formed on both side surfaces of the developing cartridge 45 at positions being obliquely more apart to the downside and the front side than the rotation shaft 41A of the developing roller 41. That is, the axis portions 45B are formed at the positions more apart from the opening of the main body 2 (see FIG. 1) than the rotation shaft 41A of the developing roller 41.

The axis portions 45B protruding from the side surfaces of the developing cartridge 45 is rotatably supported by the U-shaped bracket 26 fixed to the main body 2, whereby the developing cartridge 45 is pivotable about the axis portions 45B. Here, the bracket 26 is provided with the U-shaped groove 26A facing the upside. The front side surface 26B of the groove 26A of the bracket 26 is gradually inclined as it goes to the upside. Accordingly, since the axis portions 45B are guided to the bottom of the groove 26A of the bracket 26, the developing cartridge 45 can be easily attached to the main body 2. The stopper 24 (see FIG. 2A) according to the first exemplary embodiment is formed monolithically with the bracket 26. That is, the extensions 26D extending outward in the right-left direction along the side surface 26B are formed in the front arm portion 26C of the U-shaped bracket 26.

Operations of the process units 4" at the time of opening and closing the cover 3 of the color printer 1 according to the third exemplary embodiment will be described now. In the drawings, FIG. 11A is a side view illustrating a state of the process unit where the cover is closed, FIG. 11B is a side view illustrating a state of the process unit where it is started opening the cover, and FIG. 11C is a side view illustrating a state of the process unit where the cover is opened by a predetermined amount or more.

Figure 11A:
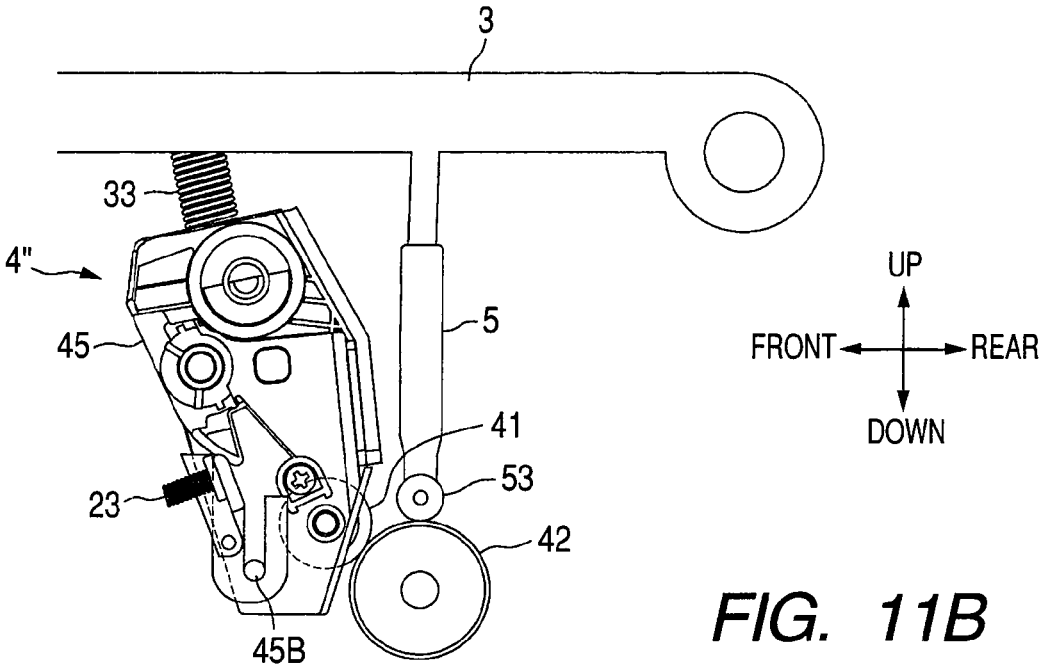
FIG. 11A is a side view illustrating a state of the process unit where the cover is closed.
Figure 11B:
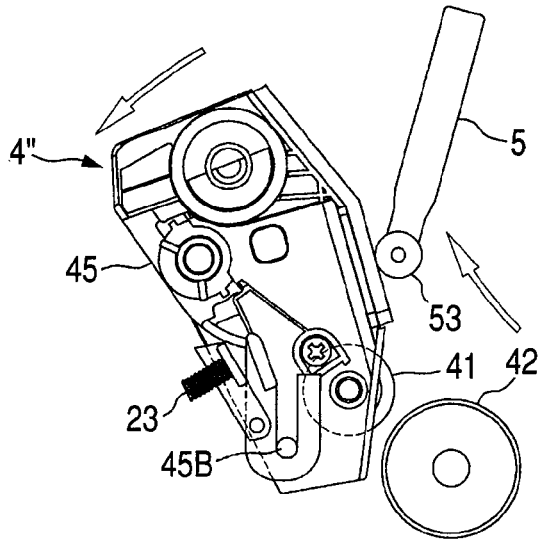
FIG. 11B is a side view illustrating a state of the process unit where it is started opening the cover.

As shown in FIGS. 11A and 11B, when it is started opening the cover 3, the LED head 5 is moved in the arc-shaped locus and presses the developing cartridge 45 to the front side. Accordingly, the developing cartridge 45 pivots about the axis portions 45B and is retreated from the movement locus of the LED head 5, and the developing roller 41 is separated from the photosensitive drum 42. When the cover 3 is further opened, the LED head 5 gets gradually apart from the developing cartridge 45 and thus the developing cartridge 45 is restored to the original position with the urging force of the spring 23, as shown in FIG. 11C.

Figure 11C:
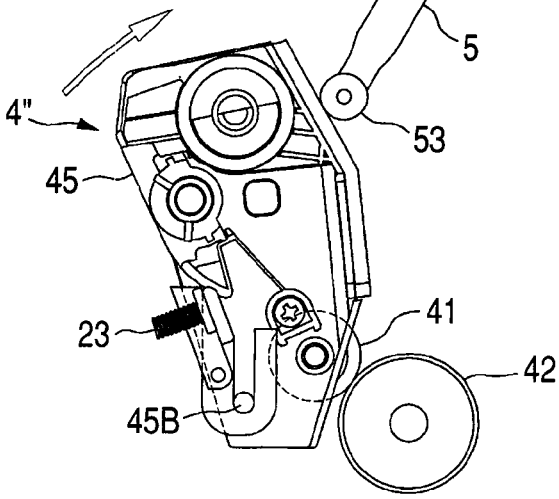
FIG. 11C is a side view illustrating a state of the process unit where the cover is opened by a predetermined amount or more.

When the cover 3 is closed, as shown in the order of FIGS. 11C to 11A, the developing cartridge 45 is pressed by the LED head 5 to be retreated from the movement locus and then is restored to the original position with the restoring force of the spring 23.

According to the above-described configurations of the third exemplary embodiment, the following advantages can be obtained.

At the time of opening and closing the cover 3, since the developing cartridge 45 as a part of the process unit 4" is pressed by the moved LED head 5 to be retreated from the movement locus of the LED head 5, it is possible to reduce the gap between the process units 4", thereby reducing the size of the apparatus.

Since the pivot center of the process unit 4" is disposed below the rotation shaft 41A of the developing roller 41, the developing roller 41 gets apart from the photosensitive drum 42 at the time of pivoting the process units 4". Accordingly, even when the separation members 7 and 7' of the first exemplary embodiment and the second exemplary embodiment are not provided, it is possible to suppress the abrasion of the developing roller 41 and the photosensitive drum 42.

While the present invention has been shown and described with reference to certain exemplary embodiments thereof, it will be understood by those skilled in the art that various changes in form and details may be made therein without departing from the spirit and scope of the present invention as defined by the appended claims.

Although the present invention is applied to the color printer 1 in the above-described exemplary embodiments, the present invention may be not the color printer, but may be applied to other image forming apparatuses such as a copier or a multi function device. Further, the present invention may also be applied to an image forming apparatus which employs only one process unit and only one LED head. In this case, it is possible to reduce a gap between the process unit and a wall of the main body.

Although the above-described exemplary embodiments employ the LED head 5, the present invention is not limited to the LED head. For example, plural light emitting elements such as EL (ElectroLuminescence) elements and fluorescent elements may be used and the light emitting elements may be selectively made to emit light. Alternatively, plural liquid crystal elements or plural optical shutters made of PLZT may be arranged and the opening and closing time of the optical shutters may be selectively controlled in on the basis of image data, thereby controlling light from a single light source or plural light sources.

Although the above-described exemplary embodiments employ the structure for pivoting the process units 4 or the developing cartridges 45, the present invention is not limited to the structure. For example, a part of the developing cartridge may be movable straightly with the pressing of the LED head.

Figure 12A:
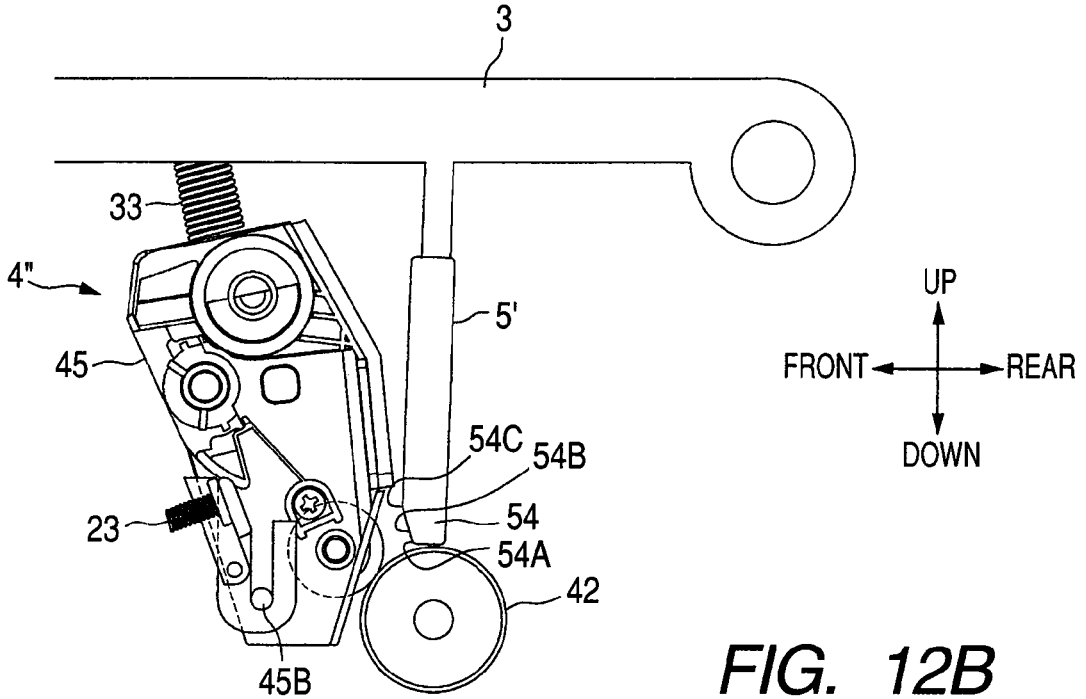
FIG. 12A is a side view illustrating a state of the process unit where the cover is closed according to a modified exemplary embodiment.
Figure 12B:
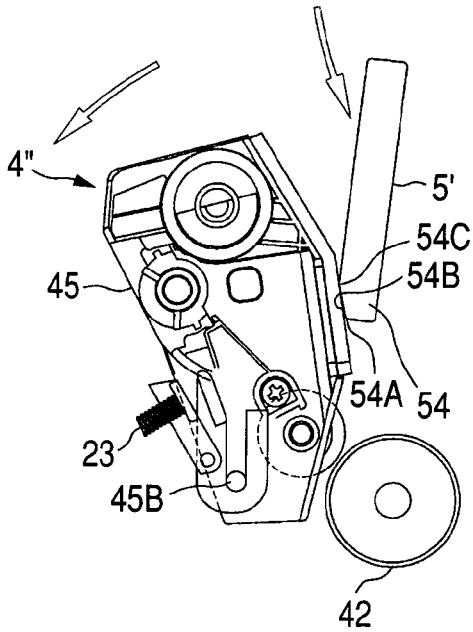
FIG. 12B is a side view illustrating a state of the process unit where the cover is closed by a predetermined amount or more.
Figure 12C:
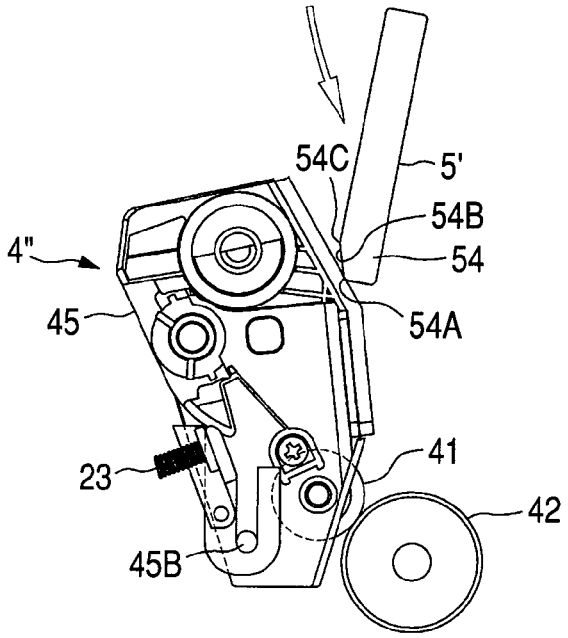
FIG. 12C is a side view illustrating a state of the process unit where it is started closing the cover.

Although the roller 53 is provided at the end of the LED head 5 in the above-described exemplary embodiments, the present invention is not limited to such configuration, but the roller may not be provided. When the roller is not provided, as shown in FIG. 12A, it may be preferable that the corner of the end 54 of the LED head 5' having a substantially rectangular shape and close to the developing cartridge 45 is chamfered. Accordingly, when the LED head 5' is moved to the photosensitive drum 42 by closing the cover 3, as shown in FIG. 12C, the front corner portion 54A of the end surface of the LED head 5' first comes in contact with the developing cartridge 45. Thereafter, when the LED head 5' is further pushed to the photosensitive drum 42, the developing cartridge 45 is temporally supported by the tilt surface 54B of the LED head 5' and then the developing cartridge 45 is supported by the corner portion 54C located at the upper edge of the tilt surface 54B, as shown in FIG. 12B. Accordingly, since the end of the LED head 5' is separated from the surface of the developing cartridge 45 thereafter, the LED head 5' can be made to smoothly slide on the surface of the developing cartridge 45. As shown in the drawings, since the corner portion 54C is rounded with a relatively great radius of curvature, that is, the corner portion 54C has a curved shape, the LED head 5' can be made to further smoothly slide. Similarly, since the corner portion 54A is rounded with a radius of curvature smaller than that of the corner portion 54C, the same effect is obtained.

Although the above-described exemplary embodiments employ coil springs 23 and 33, the present invention is not limited to the coil springs, but may employ, for example, torsion springs or leaf springs.

In the first exemplary embodiment, the photosensitive drum 42 and the belt 6 is separated from each other by properly controlling the actuator 8 which moves the separation members 7 by the controller 9, the present invention is not limited to this configuration. For example, a mechanism manually separating the photosensitive drum and the belt may be provided in the main body.

Although the above-described exemplary embodiments employ the photosensitive drum, the present invention is not limited to the photosensitive drum, but may employ a belt-like photosensitive member.

Although the above-described exemplary embodiments employ the belt 6 conveying a printing sheet as the belt opposed to the photosensitive member, the present invention is not limited to the belt, but may employ, for example, an intermediate transfer belt conveying a developer image supplied from the photosensitive member.

What is claimed is:

1. An image forming apparatus comprising:

a main body including an opening at one side thereof;

a plurality of process units which are arranged in the main body in an arrangement direction with a gap therebetween, and each of which includes a photosensitive member on which an electrostatic latent image is to be formed;

a plurality of exposure units which are arranged in the arrangement direction alternately with the process units and which expose the photosensitive members, respectively;

a cover which is rotatable about a rotation shaft at one end in the arrangement direction and which opens and closes the opening of the main body; and a plurality of support members which connect the exposure units to the cover and which allow the exposure units to be retreated from the process units with the opening and closing of the cover, wherein the rotation shaft of the cover is disposed closer to the opening of the main body than ends of the exposure units located at exposure positions for exposing the photosensitive members when the cover closes the opening of the main body, and wherein the process units are disposed at positions where the process units contact with the exposure units moved with the opening and closing of the cover and at least contact portions thereof contacting with the exposure units are movable by pressing forces of the exposure units.

2. The image forming apparatus according to claim 1, wherein the at least contact portions of the process units are pivotably supported by the main body and are restored to original positions by an elastic member.

3. The image forming apparatus according to claim 2, wherein each of the photosensitive members is disposed opposite to a belt for conveying a printing sheet or a developer image, wherein each of the process units is movable with respect to the main body so that each of the photosensitive members is movable between a close position close to the belt and a separated position more apart from the belt than the close position, wherein each of the process units is pivotable about a rotation shaft of the corresponding photosensitive member, and wherein each of the photosensitive members is located at the separated position at least during the opening and closing of the cover.

4. The image forming apparatus according to claim 3, further comprising:

a plurality of urging members which urge the photosensitive members to the close positions, respectively; and a separation member which moves each of the photosensitive members to the separated position against the urging force of the urging members by pressing the rotation shaft of each of the photosensitive members.

5. The image forming apparatus according to claim 2, wherein each of the process units includes a photosensitive cartridge having the photosensitive member and a developing cartridge having a developing roller for supplying developer to the photosensitive member, wherein each of the developing cartridges is movable with respect to the main body so that each of the developing rollers is movable between a close position close to the corresponding photosensitive member and a separated position more apart from the corresponding photosensitive member than the close position, wherein each of the developing cartridges is pivotable about a rotation shaft of the corresponding developing roller, and wherein each of the developing rollers is located at the separated position at least during the opening and closing of the cover.

6. The image forming apparatus according to claim 5, further comprising:

a plurality of urging members which urge the developing rollers to the close position, respectively; and a separation member which moves each of the developing rollers to the separated position against the urging force of the urging members by pressing the rotation shaft of each of the developing rollers.

7. The image forming apparatus according to claim 2, wherein each of the process units includes a photosensitive cartridge having the photosensitive member and a developing cartridge having a developing roller for supplying developer to the photosensitive member, and wherein a portion of each of the developing cartridge more apart from the opening of the main body than a rotation shaft of corresponding developing roller is rotatably supported by the main body.

8. The image forming apparatus according to claim 1, wherein contact surfaces of the process units with the exposure units are formed oblique with respect to a direction in which the exposure units are moved to the photosensitive members.

9. The image forming apparatus according to claim 1, wherein a corner of an end of each exposure unit close to the corresponding process unit is obliquely chamfered.

10. The image forming apparatus according to claim 1, wherein each of the exposure units includes a roller which contacts with the corresponding process cartridge and rotates.

11. An image forming apparatus comprising:

a main body including an opening;

a cover which is rotatable about a rotation shaft provided at one side of the main body to open and close the opening;

a process unit provided in the main body and including a photosensitive member;

an exposure unit which is connected to the cover and is moved with the opening and closing of the cover along a movement locus, wherein the exposure unit faces the photosensitive member when the cover closes the opening; and an elastic member which supports the process unit and is elastically deformable between an overlapping state in which the process unit overlaps with the movement locus of the exposure unit and a retreated state in which the process unit is retreated from the movement locus of the exposure unit.

* * * * *